United States Patent [19]

Nourse et al.

[11] Patent Number: 4,585,395

[45] Date of Patent: Apr. 29, 1986

[54] GAS TURBINE ENGINE BLADE

[75] Inventors: John G. Nourse, Topsfield; John J. Bourneuf, Boston; David R. Abbott, Manchester, all of Mass.

[73] Assignee: General Electric Company, Lynn, Mass.

[21] Appl. No.: 560,656

[22] Filed: Dec. 12, 1983

[51] Int. Cl.[4] ..... F01D 5/14

[52] U.S. Cl. ..... 416/223 A; 416/242; 416/DIG. 2; 415/181

[58] Field of Search ..... 416/223 A, DIG. 2, 242; 415/181

[56] References Cited

U.S. PATENT DOCUMENTS

| | | | |
|---|---|---|---|
| 2,660,401 | 11/1953 | Hull | 416/223 A X |
| 2,663,493 | 12/1953 | Keast | 416/223 A |
| 2,715,011 | 8/1955 | Schorner . | |
| 2,915,238 | 12/1959 | Szydlowski | 415/181 X |
| 3,333,817 | 8/1967 | Rhomberg | 415/181 X |
| 3,851,994 | 12/1974 | Seippel | 416/223 A |
| 3,989,406 | 11/1976 | Bliss | 416/223 A X |
| 4,012,172 | 3/1977 | Schwaar et al. | 416/223 A X |
| 4,284,388 | 8/1981 | Szewalski . | |
| 4,460,315 | 7/1984 | Tseng | 416/216 |

FOREIGN PATENT DOCUMENTS

| | | | |
|---|---|---|---|
| 2144600 | 3/1973 | Fed. Rep. of Germany | 416/242 |
| 2650433 | 12/1977 | Fed. Rep. of Germany | 416/242 |
| 916896 | 1/1963 | United Kingdom | 416/242 |
| 2064667 | 6/1981 | United Kingdom | 416/223 A |
| 646095 | 2/1979 | U.S.S.R. | 416/223 A |

OTHER PUBLICATIONS

Aviation Wk. & Space Technology—May 2, 1983, Howmet advertisement.

F404 LP Turbine Aeromechanical Summary, Feb. 12, 1976, V. M. Cardinale and R. A. McKay, four-page extract.

*Primary Examiner*—E. A. Powell, Jr.

*Attorney, Agent, or Firm*—Francis L. Conte; Derek P. Lawrence

[57] ABSTRACT

The invention comprises a blade for a gas turbine engine including an airfoil portion having a non-linear stacking axis intersecting a reference radial axis that is effective for generating a compressive component of bending stress due to centrifugal force acting on the blade. The compressive component of bending stress is provided in a life-limiting section of the blade, which, for example, includes trailing and leading edges of the blade. Inasmuch as the stacking axis, which represents the locus of centers of gravity of transverse sections of an airfoil portion of the blade, is non-linear, an increased amount of a compressive, component of bending stress can be generated at a life-limiting section between a root and tip of the blade without substantially increasing bending stress at the root of the blade due to the non-linear stacking.

27 Claims, 6 Drawing Figures

GAS TURBINE ENGINE BLADE

The Government has rights in this invention pursuant to Contract No. DAAK51-83-C-0014.

CROSS REFERENCE TO A RELATED APPLICATION

This present application is copending and concurrently filed with another patent application entitled "Bowed Turbine Blade," Jack R. Martin, Ser. No. 560,718, filed on Dec. 12, 1983, both assigned to the present assignee.

BACKGROUND OF THE INVENTION

This invention relates generally to blades for a gas turbine engine and, more particularly, to an improved blade effective for reducing stresses due to centrifugal force to improve the useful life of the blade.

An axial flow gas turbine engine conventionally includes a plurality of rows of alternating stationary vanes and rotating blades. The rotating blades are typically found in fan, compressor, and turbine sections of the engine, and inasmuch as these blades rotate for performing work in the engine, they are subject to stress due to centrifugal forces.

The centrifugal stress in a blade is relatively substantial and includes a substantially uniform centrifugal tensile stress and centrifugal bending stress including a tensile component and a compressive component which are added to the uniform tensile stress.

In a turbine section of the gas turbine engine, turbine blades are also subject to relatively hot, pressurized combustion gases. Theses gases induce bending stresses due to the pressure of the combustion gases acting across the turbine blades, which stresses are often relatively small when compared to the centrifugal stresses. The relatively hot gases also induce thermal stress due to any temperature gradient created in the turbine blade.

A turbine blade, in particular, has a useful life, i.e., total time in service after which time it is removed from service, conventionally determined based on the above-described stresses and high-cycle fatigue, low-cycle fatigue, and creep-rupture considerations. A typical turbine blade has an analytically determined life-limiting section wherein failure of the blade is most likely to occur. However, blades are typically designed to have a useful life that is well in advance of the statistically determined time of failure for providing a safety margin.

A significant factor in determining the useful life of a turbine blade is the conventionally known creep-rupture strength, which is primarily proportional to material properties, tensile stress, temperature, and time. Notwithstanding that the relatively high temperatures of the combustion gases can induce thermal stress due to gradients thereof, these temperatures when acting on a blade under centrifugal tensile stress are a significant factor in the creep consideration of the useful life. In an effort to improve the useful life of turbine blades, these blades typically include internal cooling for reducing the temperatures experienced by the blade. However, the internal cooling is primarily most effective in cooling center portions of the blade while allowing leading and trailing edges of the blade to remain at relatively high temperatures with respect to the center portions thereof. Unfortunately, the leading and trailing edges of the blade are also, typically, portions of the blade subject to the highest stresses and therefore, the life-limiting section of a blade typically occurs at either the leading or trailing edges thereof.

Furthermore, a primary factor in designing turbine blades is the aerodynamic surface contour of the blade which is typically determined substantially independently of the mechanical strength and useful life of the blade. The aerodynamic performance of a blade is a primary factor in obtaining acceptable performance of the gas turbine engine. Accordingly, the aerodynamic surface contour that defines a turbine blade may be a significant limitation in the design of the blade from a mechanical strength and useful life consideration. With this aerodynamic performance restriction, the useful life of a blade may not be an optimum, which, therefore, results in the undesirable replacement of blades at less than optimal intervals.

Accordingly, it is an object of the present invention to provide a new and improved blade for a gas turbine engine.

Another object of the present invention is to provide an improved turbine blade effective for reducing tensile stress in a life-limiting section of the blade by adding a compressive component of bending stress thereto.

Another object of the present invention is to provide an improved turbine blade having improved useful life without substantially altering the aerodynamic surface contour of the blade.

Another object of the present invention is to provide an improved turbine blade wherein tensile stress is reduced in a life-limiting section thereof without substantially increasing stress in other sections of the blade.

SUMMARY OF THE INVENTION

The invention comprises a blade for a gas turbine engine including an airfoil portion having a non-linear stacking axis effective for generating a compressive component of bending stress due to centrifugal force acting on the blade. The compressive component of bending stress is provided in a life-limiting section of the blade, which, for example, includes trailing and leading edges of the blade. Inasmuch as the stacking axis, which represents the locus of centers of gravity of transverse sections of an airfoil portion of the blade, is non-linear, an increased amount of a compressive component of bending stress can be generated at the life-limiting section between a root and tip of the blade without substantially increasing bending stress at the root of the blade due to the non-linear stacking.

BRIEF DESCRIPTION OF THE DRAWINGS

The invention, together with further objects and advantages thereof, is more particularly described in the following detailed description taken in conjunction with the accompanying drawings in which.

DETAILED DESCRIPTION

Figure 1:
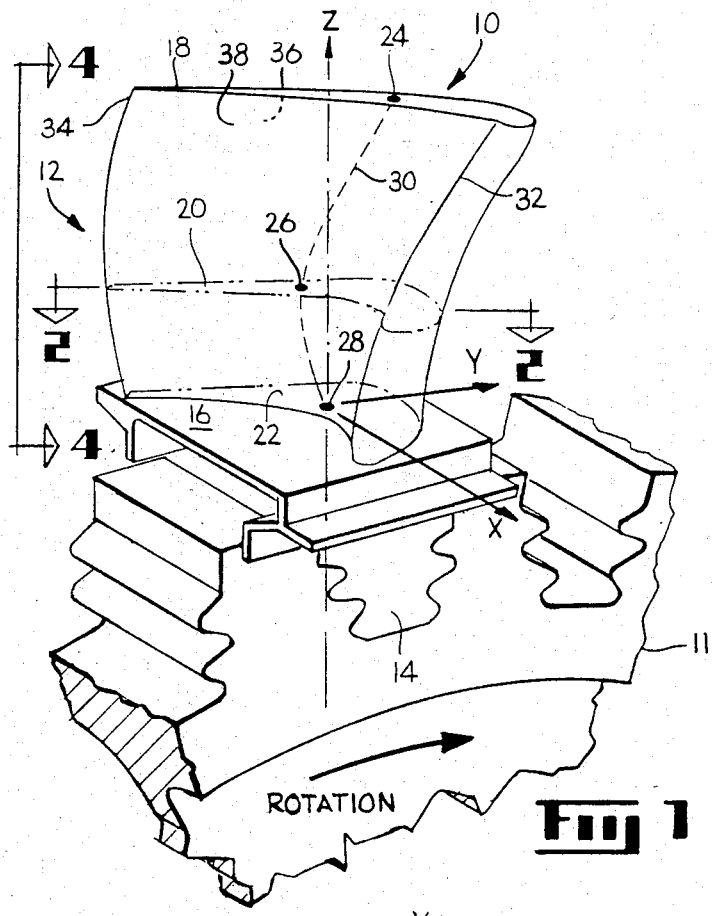
FIG. 1 is a perspective view of an axial entry blade for a gas turbine engine.

Illustrated in FIG. 1 is a generally perspective view of an exemplary axial entry turbine blade 10 mounted in a turbine disk 11 of a gas turbine engine (not shown). The blade 10 includes an airfoil portion 12, a dovetail portion 14 and an optional platform 16. The airfoil portion 12 of the blade 10 comprises a plurality of transverse sections including a tip section 18, an intermediate section 20 and a root section 22, each of which has a center of gravity (C.g.) 24, 26 and 28, respectively. The locus of the centers of gravity of the airfoil portion 12 define a stacking axis 30, which in accordance with the present invention is non-linear, e.g. bowed, and is described in further detail below.

The blade 10 further includes a conventional reference XYZ coordinate system having an origin at the C.g. 28 of the root section 22. This coordinate system includes: an X, axial axis, which is aligned substantially parallel to a longitudinal centerline axis of the gas turbine engine; a Y, tangential axis, which is normal to the X axis and has a positive sense in the direction of rotation of the turbine disk 11; and a Z, radial axis, which represents a longitudinal axis of the blade 10 which is aligned coaxially with a radial axis of the gas turbine engine.

Figure 2:
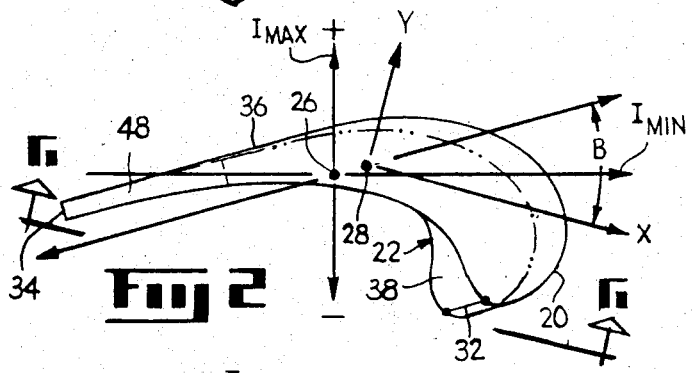
FIG. 2 is a sectional view of the blade of FIG. 1 taken along line 2—2.

As illustrated in FIGS. 1 and 2, the airfoil portion 12 of the blade 10 has an aerodynamic surface contour defined by and including a leading edge 32 and a trailing edge 34, between which extend a generally convex suction side 36 and a generally concave pressure side 38. The pressure side 38 faces generally in a negative direction with respect to the reference tangential axis Y; the suction side 36 faces generally in a positive direction with respect thereto.

Each of the plurality of transverse sections of the airfoil portion 12 of the blade 10 has its own conventionally known principal coordinate system. Illustrated in FIG. 2 is an exemplary principal coordinate system for the intermediate section 20 including an $I_{max}$ axis and an $I_{min}$ axis. The principal coordinate system has an origin at the C.g. 26 of the intermediate section 20. $I_{max}$ represents an axis of maximum moment of inertia about which the intermediate section 20 has a maximum stiffness or resistance to bending and $I_{min}$ represents an axis of minimum moment of inertia about which the intermediate section 20 has a minimum stiffness or resistance to bending.

A conventional method of designing the blade 10 includes designing the airfoil portion 12 for obtaining a preferred aerodynamic surface contour as represented by the suction side 36 and the pressure side 38. The stacking axis 30 of the airfoil portion 12 would be conventionally made linear and coaxial with the reference radial axis Z. A suitable dovetail 14 and an optional platform 16 would be added and the entire blade 10 would then be analyzed for defining a life-limiting section, which, for example, may be the intermediate section 20, which is typically located between about 40 percent to about 70 percent of the distance from the root 22 to the tip 18 of the airfoil portion 12. Of course, analyzing the blade 10 for defining a life-limiting section is relatively complex and may include centrifugal, gas and thermal loading of the blade 10, which is accomplished by conventional methods.

However, in accordance with the present invention, the method of designing the blade 10 further includes redesigning the blade having the linear stacking axis, i.e., the reference blade, for obtaining a non-linear, tilted stacking axis 30 which is effective for introducing a compressive component of bending stress in the predetermined, life-limiting section.

More specifically, it will be appreciated from an examination of FIGS. 1 and 2 that if the stacking axis 30 is spaced from the reference radial axis Z, that upon centrifugal loading of the airfoil portion 12, centrifugal force acting on the centers of gravity, C.g. 26 for example, will tend to rotate or bend the stacking axis 30 toward the reference radial axis Z thus introducing or inducing bending stress.

It will be appreciated from the teachings of this invention, that by properly tilting and spacing the stacking axis 30 with respect to the reference radial axis Z a compressive component of bending stress can be induced at both the leading edge 32 and the trailing edge 34 of the intermediate section 20 due to bending about the $I_{min}$ axis as illustrated in FIG. 2. Of course, due to equilibrium of forces, an off-setting tensile component of bending stress is simultaneously introduced in the suction side 36 of the intermediate section 20 and generally at positive values of the $I_{max}$ axis.

Figure 3:
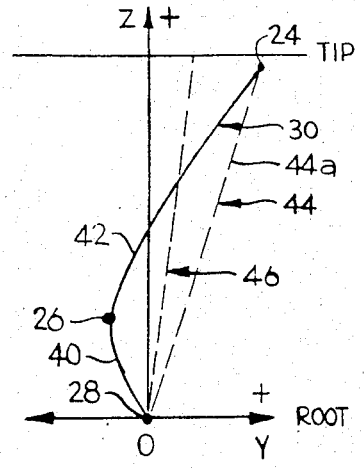
FIG. 3 is a graphical representation of the stacking axis of the blade of FIG. 1 in a Y-Z plane.

Illustrated in more particularity in FIG. 3 is an exemplary embodiment of the stacking axis 30 in accordance with the present invention and as viewed in the Y-Z plane. The stacking axis 30 is described as being non-linear from the C.g. 28 of the root section 22 to the C.g. 24 of the tip section 18 and may include either linear or curvilinear portions therebetween. As long as the stacking axis 30 has portions which extend away from and are spaced from the reference radial axis Z in a positive direction with respect to the reference tangential axis Y compressive components of bending stress will be introduced at the leading edge 32 and the trailing edge 34 of the airfoil portion 12.

The stacking axis 30 includes a first portion 40 extending from the C.g. 28 of the root section 22 to the C.g. 26 of the intermediate section 20, and a second portion 42 extending from C.g. 26 of the intermediate section 20 to the C.g. 24 of the tip section 18. Also illustrated is a reference, linearly tilted stacking axis 44 extending from the C.g. 28 of the root section 22 to the C.g. 24 of the tip section 18. The stacking axis 30 has an average slope represented by dashed line 46 which, as illustrated, is larger in magnitude than the slope of the reference axis 44 and is disposed between the reference radial axis Z and the reference stacking axis 44.

Assuming, for example, that the life-limiting section of the airfoil portion 12 is located at the intermediate section 20 it will be apparent from the teachings herein that a compressive component of bending stress can be introduced in the intermediate section 20 by using either the liner stacking axis 44 or the non-linear stacking axis 30. To introduce the desired bending stress at the intermediate section 20, the stacking axis 30 must be tilted with respect to the reference radial axis Z at those sections radially outwardly from the intermediate section 20, i.e., the second portion 42 of the stacking axis 30.

The slope of the stacking axis 30 is generally inversely proportional to the amount of bending stress realizable at the intermediate section 20. Accordingly, relatively low values of the slope of the section portion 42 are preferred and result in relatively large values of induced bending stress in the intermediate section 20. However, a relatively large value of the average slope 46 is also preferred so that relatively low bending stress is simultaneously induced in the root section 22. Additionally, the second portion 42 of the stacking axis 30 has less of a slope than that of a comparable portion 44a of the reference linear stacking axis 44, which indicates that relatively more bending stress can be introduced thereby at the intermediate section 20.

However, not only is the reference linear stacking axis 44 less effective in introducing the desired bending stress to the intermediate section 20, but inasmuch as the reference stacking axis 44 is linear from C.g. 28 to the C.g. 24, substantial, undesirable bending stresses are also introduced at the root section 22. These increased bending stresses at the root section 22 are a limit to the amount of bending stress introducible by the reference linear stacking axis 44 in the life-limiting section of the airfoil portion 12 in that the life-limiting section may thereby be relocated from the intermediate section 20 to the root section 22.

In contrast, inasmuch as the average slope line 46 of the non-linear stacking axis 30 has a magnitude greater than that of the reference stacking axis 44, it will be appreciated that not only does the non-linear stacking axis 30 provide for increased bending stress at the intermediate section 20 but less of a bending stress at the root 22 as compared to that provided by the reference linear stacking axis 44. Accordingly, a non-linear stacking axis 30 is more effective for introducing the desired compressive components of bending stress at the life-limiting section without adversely increasing the bending stresses at the root section 22.

More specifically, the stacking axis 30 according to the exemplary embodiment illustrated in FIG. 3 includes portions thereof disposed on two sides of the reference radial axis Z which are effective for obtaining increased bending stress at the intermediate section 20 without adversely increasing bending stress at the root section 22. The first portion 40 has a first average slope between C.g. 28 and C.g. 26, and the second portion 42 has a second average slope between the C.g. 26 and the C.g. 24, wherein the second slope has a negative sense with respect to the first slope. Furthermore, the first portion 40 extends from the C.g. 28 and is tilted away from the reference radial axis Z in a generally negative Y axis direction, thusly, resulting in the first slope having a negative value. The second portion 42 extends from the C.g. 26 in a positive Y direction and with a positive slope which allows the second portion 42 to intersect the reference radial axis Z at one point and extend into the positive side of the Y axis.

Inasmuch as the stacking axis 30 has portions on both sides of the reference radial axis Z, it will be appreciated that the average slope line 46 of the stacking axis 30 will have a relatively larger value than would otherwise occur if the stacking axis 30 were disposed solely on one side of the reference radial axis Z. This arrangement is effective for allowing the second portion 42 to have a relatively small second slope for introducing substantially more compressive component of bending stress at the leading edge 32 and the trailing edge 34, for example, at the intermediate section 20.

The embodiment of the invention illustrated in FIG. 3, therefore, not only allows for an increase in the desired compressive stress at the intermediate section 20 but also results in reduced stresses at the root section 22 inasmuch as the average slope line 46 can be made substantially close to, if not coaxial with, the reference radial axis Z.

Figure 4:
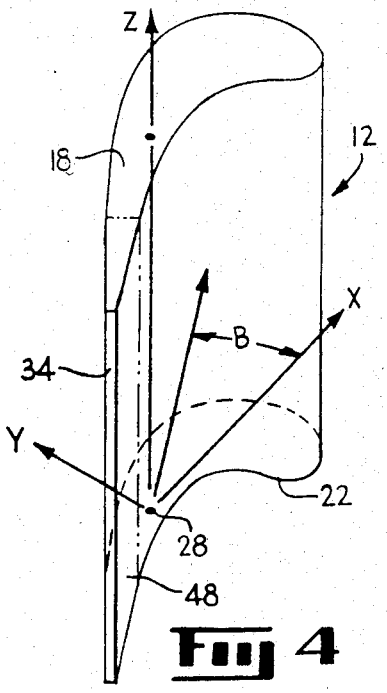
FIG. 4 is a perspective end view of the blade of FIG. 1 taken along line 4—4.

FIG. 4 illustrates an end view of the airfoil portion 12 from the trailing edge 34. The airfoil portion 12 further includes a substantially flat, relatively thin and flexible plate-like trailing edge portion 48 which extends radially inwardly from the tip portion 18 and may extend to the root portion 22 as illustrated. The trailing edge portion 48 defines a trailing edge plane and is disposed at an angle B from the X axis toward the Y axis. In accordance with another feature of the present invention, the trailing edge portion 48 is not tilted in a transverse direction and is oriented in a substantially radial direction, as additionally illustrated in FIG. 2. This is preferred for minimizing centrifugal bending stresses in the trailing edge portion 48 which would otherwise be generated if the trailing edge portion 48 was disposed at an angle with respect to the radial axis Z. This is effective for preventing distortion of the trailing edge portion 48, which would otherwise occur, for, thereby, preventing substantial changes in the aerodynamic contour thereof as well as for preventing localized creep distortion.

Accordingly, in order to maintain the preferred radial orientation of the trailing edge portion 48, and in order to introduce the desired compressive components of bending stress in the leading edge 32 and the trailing edge 34, the stacking axis 30 is tilted or disposed in a direction primarily parallel to the orientation of the trailing edge portion 48 and, therefore, lies substantially in a plane aligned substantially parallel to the trailing edge plane.

Figure 5:
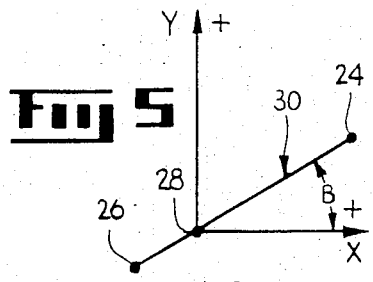
FIG. 5 is a graphical representation of the stacking axis of the blade of FIG. 1 in an X-Y plane.

More specifically, the stacking axis 30 as illustrated in FIG. 5 is disposed at an angle B with respect to the X axis toward the Y axis. The angle B represents the orientation of the trailing edge portion 48 in the X—Y plane as illustrated in FIGS. 2 and 4. Although the stacking axis 30 is not disposed in a direction substantially parallel to the Y axis, it includes components in the positive Y axis direction which will thus introduce the preferred compressive component of bending stress in the leading edge 32 and the trailing edge 34.

Figure 6:
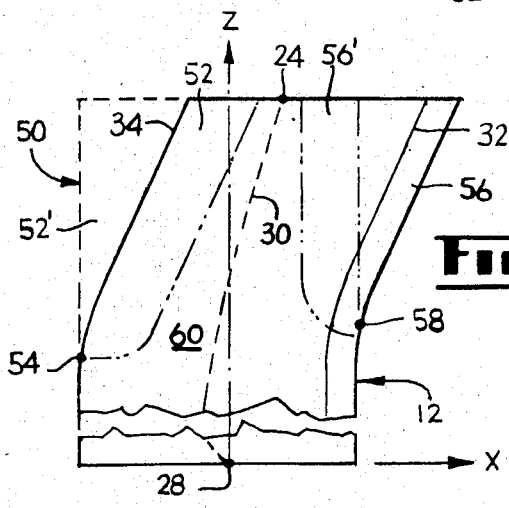
FIG. 6 is a side view of the blade of FIG. 1 in the X-Z plane.

Another advantage in accordance with the present invention from tilting the stacking axis 30 primarily in a direction parallel to the orientation of the trailing edge portion 48 is illustrated in FIG. 6. More specifically, by tilting the stacking axis 30 as above described, it will be appreciated that for a given aerodynamic surface contour, the leading edge 32 will be tilted away from the reference radial axis Z and the trailing ege 34 will be tilted toward the reference radial axis Z. As a result, the tilted airfoil portion 12 in accordance with the present invention when compared with an untilted airfoil portion represented partly in dashed line as 50 will no longer have a trailing edge tip region 52 disposed directly radially outwardly of a trailing edge intermediate region 54.

More specifically, the airfoil portion 12 includes the leading edge tip region 56 disposed radially outwardly of the leading edge intermediate region 58 and in a positive X direction therefrom. Similarly, the trailing edge tip region 52 extends in a positive X direction from the trailing edge intermediate 54 but, however, is not disposed directly radially outwardly therefrom, thusly, leaving a space 52' which would otherwise be a trailing edge tip region of the airfoil portion 12. The significance of this feature is that the trailing edge intermediate region 54 will be therefore subject to less centrifugal loading, and stresses therefrom, inasmuch as centrifugal loading from the trailing edge tip region 52 is primarily dispersed through a center region 60 of the airfoil portion 12. Although the leading edge intermediate region 58 must now absorb the centrifugal loading due to the leading edge tip region 56 disposed thereover, the increase in stress at the leading edge intermediate region 58 is relatively small inasmuch as the leading edge intermediate region 58 is substantially larger in cross-sectional area than the trailing edge intermediate region 54.

While there have been described what are considered to be preferred embodiments of the present invention, other embodiments will be apparent from the teachings herein and are intended to be covered by the attached claims.

Having thus described the invention, what is desired to be secured by Letters Patent of the United States is:

1. A blade for a gas turbine engine comprising an airfoil portion including a pressure side and a suction side joined at an edge, an intermediate section having an $I_{min}$ axis, and a non-linear stacking axis having a first portion having a first slope and a second portion having a second slope, said second slope having a negative sense with respect to said first slope, and said stacking axis being positioned in said blade to obtain bending about said $I_{min}$ axis for generating a compressive component of bending stress in said edge at said intermediate section due to centrifugal force acting on said blade.

2. A blade according to claim 1 wherein said pressure side and said suction side are joined at both a leading edge and a trailing edge and said stacking axis is positioned in said blade to obtain bending about said $I_{min}$ axis for generating a compressive component of bending stress in both said trailing edge and said leading edge at said intermediate section due to centrifugal force acting on said blade.

3. A blade according to claim 2 wherein said airfoil portion further comprises:

a plurality of transverse sections including a root section, said intermediate section, and a tip section, each having a center of gravity;

reference axial, radial and tangential axes extending outwardly from said center of gravity of said root section; and wherein said stacking axis extends from said center of gravity of said root section and is spaced from said reference radial axis at said tip section.

4. A blade according to claim 3 wherein said first portion of said stacking axis extends from said root section to said intermediate section, said second portion of said stacking axis extends from said intermediate section to said tip section and said second portion of said stacking axis intersects said reference radial axis.

5. A blade according to claim 3 wherein said pressure side faces generally in a negative direction with respect to said reference tangential axis;

said suction side faces generally in a positive direction with respect to said reference tangential axis; and wherein said first portion of said stacking axis extends away from said reference radial axis in a negative direction with respect to said reference tangential axis and said second portion thereof extends in a positive direction thereto.

6. A blade according to claim 5 wherein said airfoil portion further comprises a substantially flat trailing edge portion defining a trailing edge plane aligned generally in a radial direction and said stacking axis lies substantially in a plane aligned substantially parallel to said trailing edge plane.

7. A blade according to claim 6 wherein said trailing edge portion is aligned substantially in a radial direction.

8. A blade for a gas turbine engine comprising an airfoil portion including a leading edge, a trailing edge, a pressure side, a suction side, and a plurality of transverse sections including a root section, an intermediate section, and a tip section, each of said plurality of sections having a center of gravity, the locus of which define a stacking axis, said blade further including reference radial and tangential axes extending in a positive direction outwardly from said center of gravity of said root section toward said tip section and said suction side, respectively, said stacking axis being non-linear and having portions which extend away from and are spaced from said reference radial axis in a positive direction with respect to said reference tangential axis for introducing a compressive component of bending stress in said trailing edge and said leading edge at said intermediate section due to centrifugal force acting on said blade, said stacking axis including a first portion having a first slope and a second portion having a second slope, said second slope having a negative sense with respect to said first slope.

9. A blade according to claim 8 wherein said airfoil portion further comprises a substantially flat trailing edge portion defining a trailing edge plane aligned substantially parallel in a radial direction and said stacking axis lies substantially in a plane aligned substantially parallel to said trailing edge plane.

10. A blade according to claim 1 wherein direction of gas flow is defined as having a positive sense in a direction from said leading edge toward said trailing edge and said stacking axis progressively shifts in the same general direction of said gas flow direction from said root to said intermediate section, and progressively shifts in a direction generally opposite to said gas flow direction from said intermediate section to said tip section.

11. A blade according to claim 3 wherein said leading edge is disposed at positive values of said reference axial axis, and said stacking axis first portion is disposed at negative values thereof.

12. A blade according to claim 11 wherein said stacking axis second portion extends from negative to positive values of said reference axial axis.

13. A blade according to claim 3 wherein said stacking axis first portion is tilted away from said reference radial axis in a generally negative tangential axis direction and said first slope is negative.

14. A blade according to claim 13 wherein said stacking axis second portion extends from negative to positive values of said tangential axis and said second slope is positive.

15. A blade according to claim 3 wherein said suction side faces generally in a positive direction with respect to said reference tangential axis, and wherein said stacking axis second portion has portions which are spaced and extend away from said reference radial axis in said positive direction.

16. A blade according to claim 3 wherein each of said transverse sections has an $I_{max}$ axis and an $I_{min}$ axis, said suction side facing generally in a positive direction with respect to said $I_{max}$ axis, and said stacking axis is spaced at positive values with respect to said $I_{max}$ axis so that compressive components of bending stress are induced at both said leading edge and said trailing edge.

17. A blade according to claim 3 wherein said stacking axis is tilted with respect to said reference radial axis at transverse sections radially outwardly from said intermediate section to induce said compressive component of bending stress at trailing and leading edges of said intermediate section.

18. A blade according to claim 3 wherein said leading edge is smoothly curved in a forward direction from said root section to said tip section.

19. A blade according to claim 6 wherein said stacking axis is tilted with respect to said reference radial axis so that said leading edge is tilted away therefrom and said trailing edge is tilted toward said reference radial axis for reducing centrifugal loading of a trailing edge intermediate region.

20. A blade for a gas turbine engine comprising an airfoil portion including a pressure side and a suction side joined at an edge, an intermediate section having an $I_{min}$ axis, and a non-linear stacking axis positioned in said blade to obtain bending about said $I_{min}$ axis for introducing a compressive component of bending stress in said edge at said intermediate section due to centrifugal force acting on said blade.

21. A blade according to claim 20 wherein said pressure side and said suction side are joined at both a leading edge and a trailing edge and said stacking axis is positioned in said blade to obtain bending about said $I_{min}$ axis for introducing a compressive component of bending stress in both said trailing edge and said leading edge of said intermediate section.

22. A blade according to claim 21 wherein said airfoil portion further comprises:

a plurality of transverse sections including a root section, said intermediate section, and a tip section, each having a center of gravity;

reference radial and tangential axes extending outwardly from said center of gravity of said root section; and wherein said stacking axis extends from said center of gravity of said root section and is spaced from said reference radial axis at said tip section.

23. A blade according to claim 22 wherein said stacking axis is spaced from said reference radial axis from said intermediate section to said tip section.

24. A blade according to claim 22 wherein said pressure side faces generally in a negative direction with respect to said reference tangential axis;

said suction side faces generally in a positive direction with respect to said reference tangential axis; and wherein said stacking axis has portions extending away from said reference radial axis in a positive direction with respect to said reference tangential axis.

25. A blade according to claim 22 wherein said airfoil portion further includes a predetermined life-limiting section having an $I_{min}$ axis and an $I_{max}$ axis, said suction side facing generally in a positive direction with respect to said $I_{max}$ axis, and wherein said stacking axis is spaced from said reference radial axis in a positive direction with respect to said $I_{max}$ axis.

26. A blade for a gas turbine engine comprising an airfoil portion including a leading edge, a trailing edge, a pressure side, and a suction side, and a plurality of transverse sections including a root section, an intermediate section, and a tip section, each of said plurality of sections having a center of gravity, the locus of which define a stacking axis, said blade further including reference radial and tangential axes extending in a positive direction outwardly from said center of gravity of said root section toward said tip section and said suction side, respectively, said stacking axis being non-linear and spaced from said reference radial axis in a positive direction with respect to said reference tangential axis from said intermediate section to said tip section for introducing a compressive component of bending stress in said trailing edge and said leading edge of said intermediate section due to centrifugal force acting on said blade.

27. A blade according to claim 5 wherein said blade is a turbine blade and said reference tangential axis has a positive sense in the direction of rotation of said blade.

* * * * *